US006184866B1

(12) United States Patent
Schrum et al.

(10) Patent No.: US 6,184,866 B1
(45) Date of Patent: Feb. 6, 2001

(54) POINTING DEVICE

(75) Inventors: Allan E. Schrum, Cameron Park; Michael D. Rogers, El Dorado Hills, both of CA (US)

(73) Assignee: Varatouch Technology Incorporated, Sacramento, CA (US)

( * ) Notice: Under 35 U.S.C. 154(b), the term of this patent shall be extended for 0 days.

(21) Appl. No.: 08/939,377

(22) Filed: Sep. 29, 1997

(51) Int. Cl.[7] ..... G09G 5/08
(52) U.S. Cl. ..... 345/161; 345/157; 345/168
(58) Field of Search ..... 345/156, 157, 345/161, 162, 164; 200/5 A

(56) References Cited

U.S. PATENT DOCUMENTS

| | | | | |
|---|---|---|---|---|
| 4,026,048 | | 5/1977 | Hill et al. . | |
| 4,414,438 | | 11/1983 | Maier et al. . | |
| 4,419,653 | | 12/1983 | Waigand | 338/114 |
| 4,433,217 | | 2/1984 | Griffith . | |
| 4,439,648 | | 3/1984 | Reiner et al. . | |
| 4,479,392 | | 10/1984 | Froeb et al. | 73/862.68 |
| 4,493,219 | | 1/1985 | Sharp et al. | 73/862.05 |
| 4,511,769 | | 4/1985 | Sahakian et al. . | |
| 4,536,625 | | 8/1985 | Bebie | 200/5 A |
| 4,680,577 | * | 7/1987 | Strayer et al. | 345/160 |
| 4,687,200 | | 8/1987 | Shirai . | |
| 4,769,517 | | 9/1988 | Swinney . | |
| 4,896,003 | | 1/1990 | Hsieh . | |
| 5,162,775 | | 11/1992 | Kuramochi et al. | 338/114 |
| 5,550,339 | * | 8/1996 | Haug | 200/5 A |
| 5,659,334 | * | 8/1997 | Yaniger et al. | 345/156 |
| 5,675,309 | | 10/1997 | DeVolpi . | |
| 5,689,285 | * | 11/1997 | Asher | 345/161 |
| 5,790,102 | | 8/1998 | Nassimi . | |
| 5,815,139 | * | 9/1998 | Yoshikawa et al. | 345/157 |
| 5,889,507 | * | 3/1999 | Engle et al. | 345/161 |

FOREIGN PATENT DOCUMENTS

| | | | |
|---|---|---|---|
| 5-304007 | 11/1993 | (JP) | H01C/10/10 |

* cited by examiner

*Primary Examiner*—Steven J. Saras
*Assistant Examiner*—Fritz Alphonse
(74) *Attorney, Agent, or Firm*—Townsend & Townsend and Crew LLP

(57) ABSTRACT

A pointing device comprises a substrate with an electrically conductive surface and a resilient boot. The resilient boot resiliently supports a resistive surface to contact the electrically conductive surface in a pressed mode when a force is applied to push and deform the resilient boot against the electrically conductive surface. The resilient boot is made of a resistive rubber material. The resistive surface has a voltage variance and is curved to be rocked on the electrically conductive surface in the pressed mode. The voltage variance is detected on the electrically conductive surface and a variable signal is generated and processed. At least one inner switch is provided near the center region of the electrically conductive surface and the inner switch is activated by the resistive surface in the pressed mode. When the force is removed, the resistive resilient boot returns to its undeformed state and the resistive surface is spaced from the electrically conductive surface in a rest mode.

33 Claims, 3 Drawing Sheets

POINTING DEVICE

FIELD OF THE INVENTION

This invention relates generally to pointing devices and, more particularly to an improved pointing device which includes a resistive resilient diverter and an electrically conductive substrate surface.

BACKGROUND OF THE INVENTION

Pointing devices including joysticks are known in the art. Traditional joysticks have been used primarily as a gaming controller, although they have also been employed as general mouse replacement devices. In a typical application, the joystick pointing device is connected via cables to a microcontroller of a computer with a display and a keyboard. The traditional joystick has many moving parts, and the size of the mechanism therein prohibits its use in many applications, including remote controls, keyboards, and notebooks. On the other hand, joysticks have the advantages of reliability and performance.

Recent developments have produced joysticks of fewer moving parts and miniaturized joysticks suitable for integration in many types of devices. These improved joysticks, however, still have multiple components and moving parts. The prior joysticks are complex and difficult to manufacture.

SUMMARY OF THE INVENTION

There is therefore a need for a simply structured pointing device that has fewer components and fewer moving parts, has high performance and reliability, and is easy to manufacture.

It is a feature of this invention to provide a compact, simply structured pointing device that includes a reduced number of components.

It is another feature of the invention to provide a pointing device that includes only one moving part.

It is another feature of the invention to provide a pointing device that is miniaturized.

It is another feature of this invention to provide a pointing device that can be built into a notebook or standard computer.

It is another feature of the invention to provide a pointing device that can be used for remote control devices.

It is another feature of this invention to provide a pointing device that is impervious to the external environment.

It is yet another feature of the invention to provide a pointing device with digital and analog integration including a digital switch and/or wake-up feature for conserving battery life which is ideal for remote control application.

One aspect of the present invention is a pointing device which comprises a substrate having an electrically conductive surface and a resilient boot supported by the substrate along an outer edge. The resilient boot is spaced from the electrically conductive surface in a rest mode. The resilient boot is displaceable relative to the substrate by a force and resiliently returns to the rest position with removal of the force. The resilient boot has electrical contact with a plurality of spaced contacts distributed adjacent the outer edge. The plurality of spaced contacts are voltage-potential-energized to form a voltage variance over a resistive rocking surface of the resilient boot. The resistive rocking surface is displaceable to contact a portion of the electrically conductive surface at an electrical contact position to generate a signal through the electrically conductive surface with the voltage variance in a pressed mode. The resistive rocking surface is displaceable to rock on the electrically conductive surface to change the electrical contact position between the resistive rocking surface and the electrically conductive surface to produce a corresponding change in the signal.

Another aspect of the invention is a pointing device comprising an electrically conductive surface and a diverter. The diverter includes a resistive rolling surface having a voltage variance and means for resiliently supporting the resistive rolling surface in an undeflected mode spaced from the electrically conductive surface. The resistive rolling surface is movable to contact a portion of the electrically conductive surface in a deflected mode. The resistive rolling surface is movable to roll over the electrically conductive surface to contact a different portion of the electrically conductive surface.

In accordance with another aspect of this invention, an electrically conductive surface is provided in a pointing device for contacting a resistive surface having a voltage variance when the resistive surface is pushed toward the electrically conductive surface and rolled to transfer the voltage variance. The electrically conductive surface comprises at least one inner switch and an outer conductive region. A nonconductive gap separates each inner switch from the outer conductive region.

BRIEF DESCRIPTION OF THE DRAWINGS

The preferred embodiments of this invention, illustrating all their features, will now be discussed in detail. These embodiments depict the novel and nonobvious pointing device of this invention shown in the accompanying drawings, which are included for illustrative purposes only. These drawings include the following figures, with like numerals indicating like parts.

DESCRIPTION OF THE PREFERRED EMBODIMENT

Figure 1:
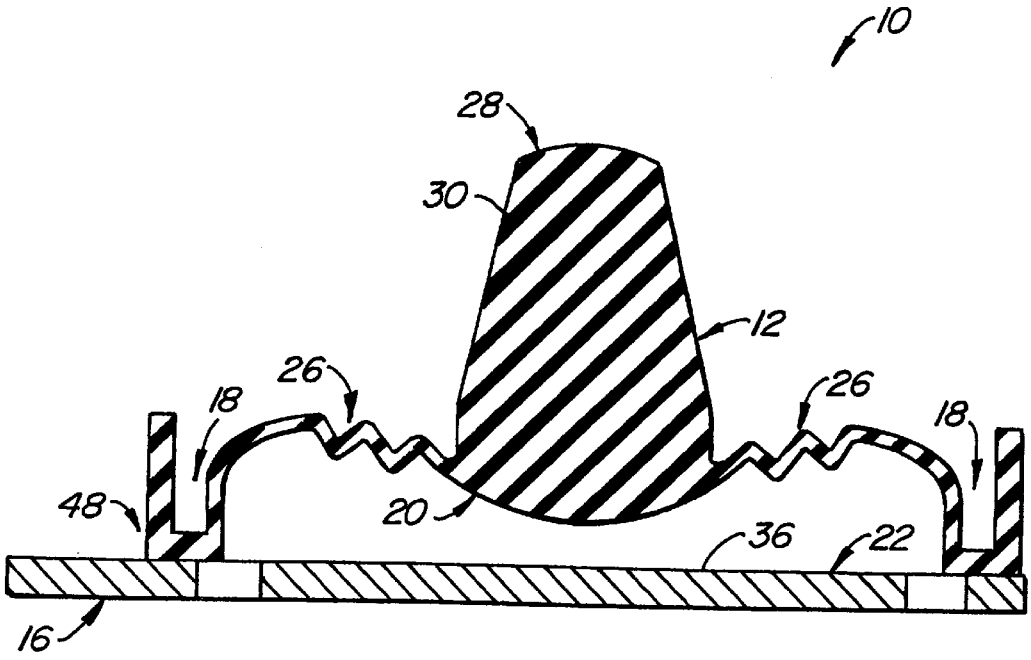
FIG. 1 is a partial cross-sectional view illustrating a pointing device of the present invention in an undeflected mode.

The pointing device 10 of FIG. 1 includes a resilient boot or contact member 12 supported on a nonconductive substrate 16. The resilient boot 12 is desirably connected to the substrate 16 along its outer edge 18. The outer edge 18 may have any shape, and desirably is substantially circular. The resilient boot 12 is also desirably a generally circular member with cross-sections through its center having the shape shown in FIG. 1.

The resilient boot 12 has a resistive surface 20 spaced from the upper surface 22 of the substrate 16. The resistive surface 20 is resiliently supported to be movable or displaceable between the rest mode or undeflected mode shown in FIG. 1 and the pressed mode or deflected mode shown in FIG. 2, in which the resistive surface 20 is pressed in the direction of the arrow 23 to make contact with the upper surface 22 of the substrate 16 to form a contact location 24. The resilient boot 12 advantageously includes a flexible member or support 26 that resiliently supports the resistive surface 20 to move between the rest mode and the pressed mode. The flexible member 26 is connected between the resistive surface 20 and the outer edge 18 of the resilient boot 12. One embodiment of the flexible member 26 is an annular bellow shown in FIGS. 1 and 2. The annular bellow 26 deforms in an accordion-like manner upon the application of a force on the resilient boot 12 to move the resistive surface 20 toward the substrate 16. It is understood that other flexible members may be used to resiliently support the resistive surface 20.

The resistive surface 20 desirably is curved to roll or rock on the upper surface 22 of the substrate 16 in the pressed mode. The resistive surface 20 desirably has a convex shape. As the resistive rocking surface 20 rocks on the upper surface 22, the contact location 24 between the resistive surface 20 and the upper surface 22 is changed. The resistive surface 20 is advantageously deformable such that the contact location 24 between the resistive surface 20 and the upper surface 22 increases in area with an increased deflection caused by a larger force exerted on the resilient boot 12. The resistive surface 20 comprises a resistive material which is desirably a resistive rubber. Advantageously, the resistance over the resistive surface 20 is substantially uniform.

As shown in FIG. 1, the resilient boot 12 advantageously includes a stick or joystick 28 extending from the resistive surface 20. The stick 28 is operable by a human hand or finger(s) to press the resistive surface 20 toward the substrate 16. In the preferred embodiment, the stick 28 extends generally perpendicularly to the upper surface 22 of the substrate 16, although other orientations for the stick 28 are acceptable. The stick 28 desirably has a tapered side surface 30 for comfort and ease in handling. The stick 28 may be made of a variety of materials, including rubber.

The stick 28, resistive surface 20, and flexible member 26 may be made of the same material, desirably a resistive, low durameter rubber. The resistive rubber may include a resistive material, such as carbon or a carbon-like material, imbedded in a rubber material. The resistive rubber advantageously has a substantially uniform or homogeneous resistance. In most applications, the resistive rubber used has a moderate resistance below about 50 thousand ohms and more desirably below about 25 thousand ohms, for instance, between about 5,000 and 10,000 ohms. The resistive rubber boot 12 formed by the stick 28, resistive surface 20, and flexible member 26 may be made, for instance, by molding.

Figure 2:
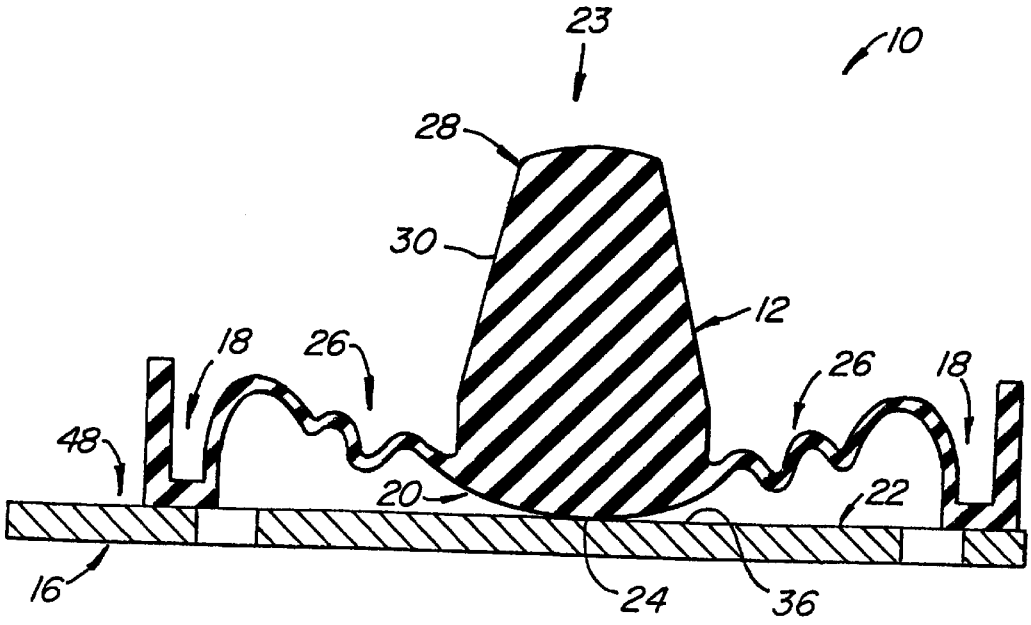
FIG. 2 is a partial cross-sectional view illustrating the pointing device of FIG. 1 in a deflected mode.
Figure 3:
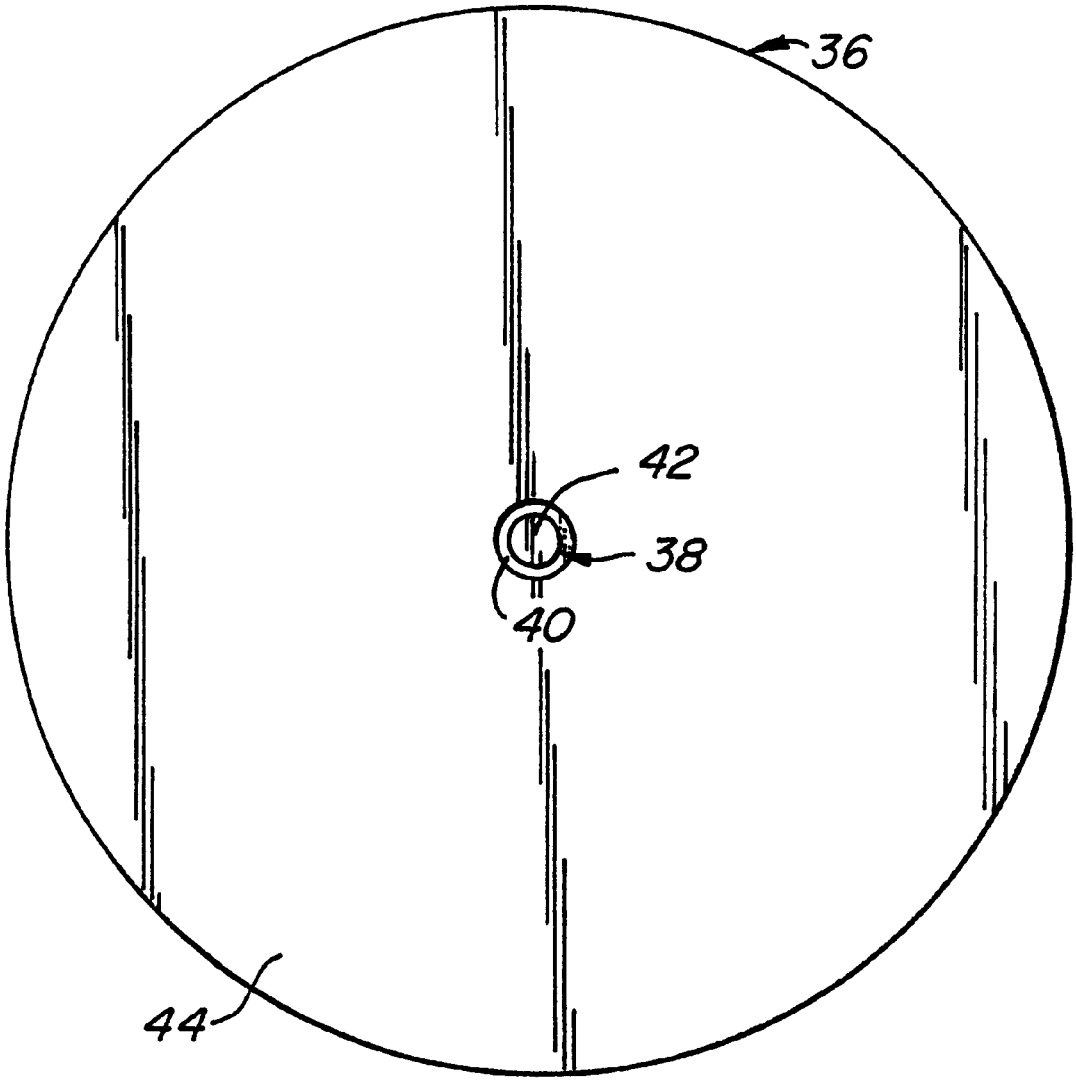
FIG. 3 is a plan view of an embodiment of an electrically conductive surface on a substrate of the pointing device of FIG. 1.

The upper surface 22 of the substrate 16 comprises an electrically conductive surface 36 on which the resistive surface 20 of the resilient boot 12 contacts in the pressed mode. As shown in FIGS. 1–3, the electrically conductive surface 36 is desirably planar in shape and substantially circular. The electrically conductive surface 36 has a conductive material such as copper.

Referring to FIG. 3, the electrically conductive surface 36 may include a switch 38, which desirably is an inner switch 38 that comprises an electrically conductive center 42 separated from an electrically conductive annulus 44 by a nonconductive electrical switch gap or ring 40. The nonconductive ring 40 may be formed by part of the substrate. The area of the electrically conductive center 42 and the width of the nonconductive electrical switch ring 40 are desirably small compared to the area of the resistive surface 20. Advantageously, the resistive surface 20 can be deflected by a human hand or finger(s) to make contact with the electrically conductive surface 36 over a contact location 24 that includes both the electrically conductive center 42 and the electrically conductive annulus 44 across the nonconductive ring 40. In a preferred embodiment, the electrically conductive center 42 is located at the center of the electrically conductive surface 36 which is spaced from the resistive surface 20 by the shortest distance and aligned with the axis of the stick 28.

In use, a voltage variance is provided over the resistive surface 20, and desirably over the resistive resilient boot 12. The voltage variance can be produced by any method known in the art. For example, the voltage variance can be created by electrically contacting the resistive resilient boot 12 with a plurality of electrical contacts 48 spaced along its outer edge 18. There are at least two, and desirably four, such electrical contacts 48. Each pair of opposite electrical contacts 48 are energized with a voltage potential. The voltage-potential-energized electrical contacts 48 produce a voltage variance across the resistive surface 20 of the resistive resilient boot 12. In applications where the pointing device 10 is used with microprocessors, the typical voltage applied to the electrical contacts 48 is about 3–5 volts. The voltage can be different for other applications.

When the stick 28 of the resilient boot 12 is pushed toward the substrate 16 as illustrated in FIG. 2, the flexible member 26 deforms in an accordion-like manner and an electrical contact location 24 is created between the resistive surface 20 and the electrically conductive surface 36 in the pressed mode. The resilient boot 12 functions as force diverter. In the pressed mode, the resistive surface 20 transfers a voltage to the electrically conductive surface 36 with a resistive value determined by the electrical contact location 24 on the resistive surface 20.

When the resistive surface 20 is rocked or rolled on the electrically conductive surface 36 or pressed to deform further by a stronger force, the electrical contact location 24 is transferred and the area of contact is changed. The change in the contact location 24 and area causes a voltage variation due to the change in the resistive value of a different contact location 24 and area on the resistive surface 20. By rocking the resistive surface 20 over the electrically conductive surface 36, the voltage variance of the resistive surface 20 can be detected on the electrically conductive surface 36. Using methods known in the art, the detected information can be used to calculate the location of contact 24 between the resistive surface 20 and the electrically conductive surface 36. The resilient boot 12 returns to its original undeformed position with the resistive surface 20 spaced from the electrically conductive surface 36 when the force is removed.

If the electrically conductive surface 20 has the configuration shown in FIG. 3, the electrical switch 38 is activated when the resilient boot 12 is deflected in the pressed mode. Because the stick 28 is aligned with the switch 38, the force applied on the stick 28 generally transfers down the axis of the stick 28 toward the switch 38. As the resistive surface 20 electrically contacts the electrically conductive center 42 and the electrically conductive annulus 44 by bridging the nonconductive gap or ring 40, the switch 38 is activated. The switch 38 may be used for a range or applications as known to those of ordinary skill in the art, such as mouse clicks.

When the pointing device 10 is used in applications such as a remote control device, where conservation of battery power is desired, the pointing device 10 desirably includes a digital wake up feature. In this case, the voltage variance is not applied to the resistive surface 20 when the pointing device 10 is in the rest mode. The voltage variance is applied only when there is electrical contact between the resistive surface 20 and the electrically conductive surface 36 in the pressed mode and a digital wake up signal is produced. As a result, energy is conserved and the battery life can be extended. Details of a digital wake up device are known in the art and not repeated here.

When the resistive surface 20 rocks on the electrically conductive surface 36 in the pressed mode, the voltage variance is detected on the electrically conductive surface 36 and a variable signal is produced. The signal is received and processed by a device such as a microcontroller (not shown) which interprets the signal data and generates an output to a relevant receiver such as a display (not shown).

Figure 4:
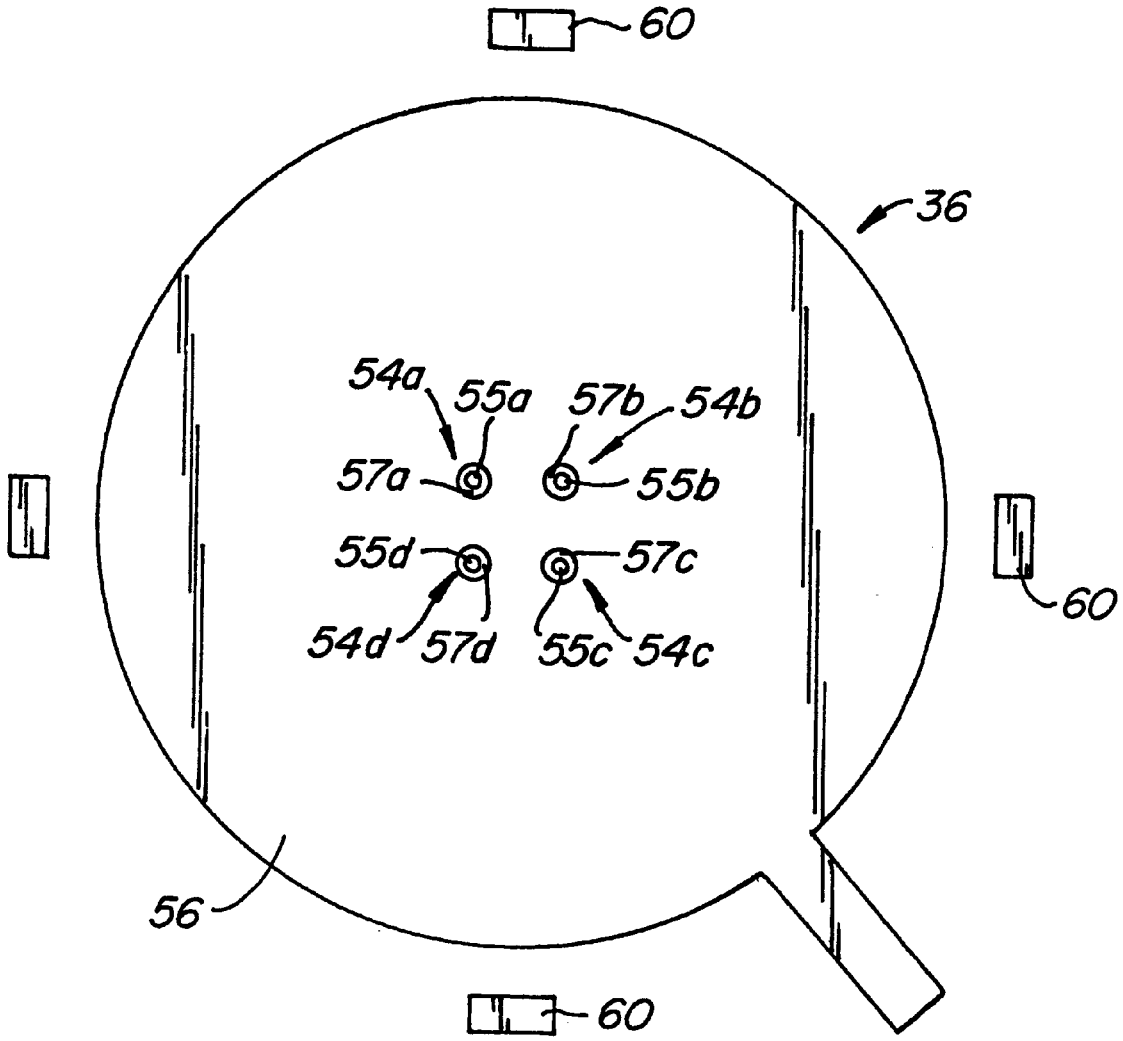
FIG. 4 is a plan view of another embodiment of an electrically conductive surface on a substrate of the pointing device of FIG. 1.

FIG. 4 shows another embodiment of the electrically conductive surface 36 which includes a plurality of inner switch contacts 54*a*, 54*b*, 54*c*, 54*d* that each comprise an electrically conductive center 55*a*, 55*b*, 55*c*, 55*d* separated from an electrically conductive exterior 56*a*, 56*b*, 56*c*, 56*d* by a nonconductive electrical switch gap or ring 57*a*, 57*b*, 57*c*, 57*d*. The inner switch contacts 54*a*, 54*b*, 54*c*, 54*d* are close to and symmetrically spaced from the center of the conductive surface 36 which is aligned with the axis of the stick 28, and are generally similar in structure to the switch contact 42 of FIG. 3. The area of the electrically conductive center 55*a* (55*b*, 55*c*, 55*d*) and the width of the nonconductive electrical switch ring 57*a* (57*b*, 57*c*, 57*d*) of each inner switch contact 54*a* (54*b*, 54*c*, 54*d*) are desirably small compared to the area of the resistive surface 20. As in the embodiment of FIG. 3, each nonconductive ring 57*a* (57*b*, 57*c*, 57*d*) may be formed by part of the substrate. FIG. 4 shows a plurality of electrical contact pads 60 that may be provided for supplying the voltage variance to the resistive surface 20 of the resistive boot 12. As discussed above, other configurations and methods of providing the voltage variance may be used.

When the resistive surface 20 is deflected by applying a force on the stick 28 which is aligned with the center of the conductive surface 36, it initially makes contact with the electrically conductive surface 36 near the center of the conductive surface 36. Under a normal force, the resistive surface 20 does not form an electrical contact with the switch contacts 54*a*, 54*b*, 54*c*, 54*d* to activate the contacts as they are spaced from the center of the conductive surface 36. Even when the resistive surface 20 is rolled on the electrically conductive surface 36, it does not contact more than one of the switch contacts. When the force on the resistive surface 20 is increased by pressing harder on the stick 28, the resilient resistive surface 20 deforms and the footprint of the surface 20 is enlarged to be able to contact two of the switch contacts 54*a*, 54*b*, 54*c*, 54*d* at the same time, bridging the two switch contacts for activation. Because of the generally square configuration, the resistive surface is more like to contact two adjacent switch contacts rather than two diagonally disposed switch contacts. In one embodiment, each of the pair of diagonally disposed switch contacts are connected to the same electrical point and adjacent switch contacts are connected to different electrical points. Therefore, switch activation only occurs with a force higher than a normal force on the stick 28 to make contact between the resistive surface 20 and two switch contacts. The configuration with the switch contacts 54*a*, 54*b*, 54*c*, 54*d* may be used for a range or applications as known to those of ordinary skill in the art.

When the resistive surface 20 rolls on the electrically conductive surface 36, the voltage variance is detected on the electrically conductive surface 36 and a variable signal is produced. The signal is received and processed by a device such as a microcontroller (not shown) which interprets the signal data and generates an output to a relevant receiver such as a display (not shown).

The pointing device 10 is compact and simple, and has only two components, namely, the resistive diverter 12 and the substrate 16 with the electrically conductive surface 36. The resistive diverter 12 is the only moving part. The resistive diverter 12 encloses the electrically conductive surface 36, making it impervious to external environmental effects. The pointing device 10 can be miniaturized and built into a notebook or standard computer. It can also be used in remote control devices.

It will be understood that the above-described arrangements of apparatus and methods therefrom are merely illustrative of applications of the principles of this invention and many other embodiments and modifications may be made without departing from the spirit and scope of the invention as defined in the claims.

What is claimed is:

1. A pointing device comprising:

a substrate having an electrically conductive surface;

a resilient boot supported by said substrate along an outer edge, said resilient boot spaced from said electrically conductive surface in a rest mode and displaceable relative to said substrate by a force and resiliently returning to said rest position with removal of said force, said resilient boot having electrical contact with a plurality of spaced contacts distributed adjacent said outer edge, said plurality of spaced contacts being voltage-potential-energized to form a voltage variance over a resistive rocking-surface of said resilient boot, said resistive rocking surface displaceable to contact a portion of said electrically conductive surface at an electrical contact position to generate a signal through said electrically conductive surface with said voltage variance in a pressed mode, said resistive rocking surface displaceable to rock on said electrically conductive surface to change said electrical contact position between said resistive rocking surface and said electrically conductive surface to produce a corresponding change in said signal.

2. The pointing device of claim 1, wherein said resilient boot is substantially circular.

3. The pointing device of claim 1, wherein said resilient boot comprises an annular bellow connected between said resistive rocking surface and said outer edge.

4. The pointing device of claim 1, wherein said resistive rocking surface is convex.

5. The pointing device of claim 1, wherein said resilient boot comprises resistive material.

6. The pointing device of claim 5, wherein said resistive material comprises resistive rubber.

7. The pointing device of claim 6, wherein said resistive rubber material comprises rubber embedded with carbon or other conductive material.

8. The pointing device of claim 1, wherein said plurality of spaced contacts comprises two pairs of equally spaced opposite contacts, each said pair of opposite contacts being energized with a voltage potential.

9. The pointing device of claim 1, wherein said resistive rocking surface has a resistance of under about 50 kilo-ohms.

10. The pointing device of claim 9, wherein said resistive rocking surface has a resistance of about 5,000 to 10,000 ohms.

11. The pointing device of claim 1, wherein said resistive rocking surface has a substantially uniform resistance.

12. The pointing device of claim 1, wherein said resistive rocking surface is deformable.

13. The pointing device of claim 1, wherein said electrically conductive surface comprises at least one electrical switch separated from an outer conductive portion by a nonconductive switch ring, said at least one electrical switch activated with said resistive rocking surface connecting said switch and said outer conductive portion across said nonconductive switch ring.

14. The pointing device of claim 13, wherein said at least one electrical switch comprises a conductive material.

15. The pointing device of claim 13, wherein said resilient boot comprises a stick extending from said resistive rocking surface and generally aligned with said center region of said electrically conductive surface.

16. The pointing device of claim 1, further comprising a digital wake up device which activates said plurality of spaced contacts to produce said voltage variance over said resistive rocking surface only when said resistive rocking surface contacts said electrically conductive surface.

17. A pointing device comprising:

an electrically conductive surface;

a diverter including a resistive rolling surface having a voltage variance and means for resiliently supporting said resistive rolling surface in an undeflected mode spaced from said electrically conductive surface, said resistive rolling surface being movable to contact a portion of said electrically conductive surface and to roll over said electrically conductive surface to contact a different portion of said electrically conductive surface in a deflected mode.

18. The pointing device of claim 17, wherein said means comprises a flexible member connecting said resistive rolling surface to a substrate fixed relative to said electrically conductive surface.

19. The pointing device of claim 18, wherein said flexible member is generally annular having an inner edge connected to said resistive rolling surface and an outer edge connected to said substrate.

20. The pointing device of claim 18, wherein said flexible member comprises a bellow.

21. The pointing device of claim 18, wherein said flexible member comprises resistive rubber.

22. The pointing device of claim 21, wherein said resistive rubber comprises carbon or other conducting material embedded in rubber.

23. An electrically conductive surface in a pointing device for contacting a resistive surface having a voltage variance when the resistive surface is pushed toward the electrically conductive surface and rolled to transfer the voltage variance, said electrically conductive surface comprising:

at least one inner switch;

an outer conductive region; and a nonconductive gap separating each of said at least one inner switch from said outer conductive region.

24. The electrically conductive surface of claim 23, wherein said at least one inner switch is substantially circular and said outer conductive region is substantially annular.

25. The electrically conductive surface of claim 23, wherein said nonconductive gap comprises a nonconductive ring.

26. The electrically conductive surface of claim 23, wherein said at least one inner switch and nonconductive gap are substantially smaller in area than said resistive surface.

27. The electrically conductive surface of claim 23, wherein the at least one inner switch is electrically conductive and activated when said resistive surface connects said inner switch and said outer conductive region.

28. The electrically conductive surface of claim 23, wherein said at least one inner switch, outer conductive region, and nonconductive gap are substantially planar.

29. The electrically conductive surface of claim 23, wherein said at least one inner switch is located near a center region of said electrically conductive surface.

30. A pointing device comprising:

a substrate having an electrically conductive surface;

a resilient member supported on the substrate to move between a contact mode and a noncontact mode, the resilient member including a resistive rocking surface which is energizable with a voltage variance, the resistive rocking surface of the resilient member being spaced from the electrically conductive surface in the noncontact mode, the resistive rocking surface of the resilient member contacting the electrically conductive surface in the contact mode at an electrical contact position to generate a signal with the voltage variance, the resistive rocking surface of the resilient member being displaceable to rock on the electrically conductive surface to change the electrical contact position between the resistive rocking surface of the resilient member and the electrically conductive surface of the substrate to produce a corresponding change in the signal.

31. The pointing device of claim 30, wherein the resistive surface of the resilient member comprises resistive rubber.

32. The pointing device of claim 30, wherein the resistive surface of the resilient member has a substantially uniform resistance.

33. The pointing device of claim 30, wherein the electrically conductive surface of the substrate is continuous.

* * * * *